United States Patent [19]

Le-Hong

[11] 4,234,071

[45] Nov. 18, 1980

[54] DEVICE FOR CHECKING METAL PIECES, PARTICULARLY COINS

[75] Inventor: Son Le-Hong, Villebon sur Yvette, France

[73] Assignee: Compagnie de Signaux et d'Enterprises Electriques, Paris, France

[21] Appl. No.: 956,921

[22] Filed: Nov. 2, 1978

[30] Foreign Application Priority Data

Nov. 3, 1977 [FR] France ..... 77 33014

[51] Int. Cl.[3] ..... G07F 3/02

[52] U.S. Cl. ..... 194/100 A; 194/100 R

[58] Field of Search ..... 194/100 R, 100 A; 209/571; 73/163; 235/92 CN

[56] References Cited

U.S. PATENT DOCUMENTS

| | | | |
|---|---|---|---|
| 3,152,677 | 10/1964 | Phillips | 194/100 R |
| 3,506,103 | 4/1970 | Kückens et al. | 194/100 R |
| 3,901,368 | 8/1975 | Klinger | 194/100 A |
| 4,105,105 | 8/1978 | Braum | 194/100 A |

FOREIGN PATENT DOCUMENTS

| | | | |
|---|---|---|---|
| 2716740 | 10/1978 | Fed. Rep. of Germany | 194/100 A |

*Primary Examiner*—Joseph J. Rolla

*Attorney, Agent, or Firm*—Cesari and McKenna

[57] ABSTRACT

A device for checking coins or other metal pieces has an electromagnetic detector responsive to the passage of the coins which produces an output voltage which varies as a result of the passing coins. This voltage is measured at predetermined periods and compared with programmed voltage values stored in a memory and which are characteristic of the coins to be checked.

8 Claims, 4 Drawing Figures

Fig.4

| | | |
|---|---|---|
| 1 | 1 | $B_{1-1}$ |
| | | $H_{1-1}$ |
| | 2 | $B_{1-2}$ |
| | | $H_{1-2}$ |
| | 3 | $B_{1-3}$ |
| | | $H_{1-3}$ |
| | 4 | $B_{1-4}$ |
| | | $H_{1-4}$ |
| 2 | 1 | $B_{2-1}$ |
| | | $H_{2-1}$ |
| | 2 | $B_{2-2}$ |
| | | $H_{2-2}$ |
| | 3 | $B_{2-3}$ |
| | | $H_{2-3}$ |
| | 4 | $B_{2-4}$ |
| | | $H_{2-4}$ |
| | | |
| 5 | 1 | $B_{5-1}$ |
| | | $H_{5-1}$ |
| | 2 | $B_{5-2}$ |
| | | $H_{5-2}$ |
| | 3 | $B_{5-3}$ |
| | | $H_{5-3}$ |
| | 4 | $B_{5-4}$ |
| | | $H_{5-4}$ |

DEVICE FOR CHECKING METAL PIECES, PARTICULARLY COINS

The present invention relates to a device for checking metal pieces, which can be used particularly for the recognition of coins or tokens, but which can also be applied to the inspection of various parts such as bearings or gear wheels.

The coin checking devices presently available on the market generally resort to the measurement of the mechanical characteristics of parts, such as their weight, diameter or thickness, these measurements being combined, or not being combined, with electric or electromagnetic measurements characterising the nature of the metal of the piece to be checked. They are often quite complex and therefore unreliable, particularly when several types of pieces are to be inspected with the same apparatus. Moreover, the time necessary for the effective recognition of each piece is far from negligible, which presents problems in certain special applications, such as the automatic toll on motorways.

Therefore, the principal aim of the present invention is to overcome these disadvantages and, for this purpose, it relates to a device for checking metal pieces characterised essentially in that it comprises, in combination, an electromagnetic detector sensitive to the passing of metal pieces and formed by a tank circuit fed from an alternating current generator of constant effective value, means for measuring at predetermined times the variations in voltage caused by variations in the impedance of the tank circuit as a result of the passing of the pieces, and means for comparing the thus measured voltage values with programmed voltage values stored in a memory and representing the characteristic curves of the pieces to be checked.

In the following description it will be seen more clearly that different types of pieces can therefore be recognized with a single detector in a simple and rapid manner.

Each measuring stage is divided into as many periods as there are types of pieces to be checked and each period is in turn divided into two half-periods corresponding respectively to the comparison with a low threshold and a high threshold of the characteristic curve.

The memory preferably comprises an integrated circuit capable of being series mounted and thus permitting the checking device to be easily adapted to different programs corresponding for example to coins of different countries.

An embodiment of the invention is described below by way of example, with reference to the accompanying drawings in which:

FIG. 4 is a table showing the different measuring sequences for recognizing four types of coins.

Figure 1:
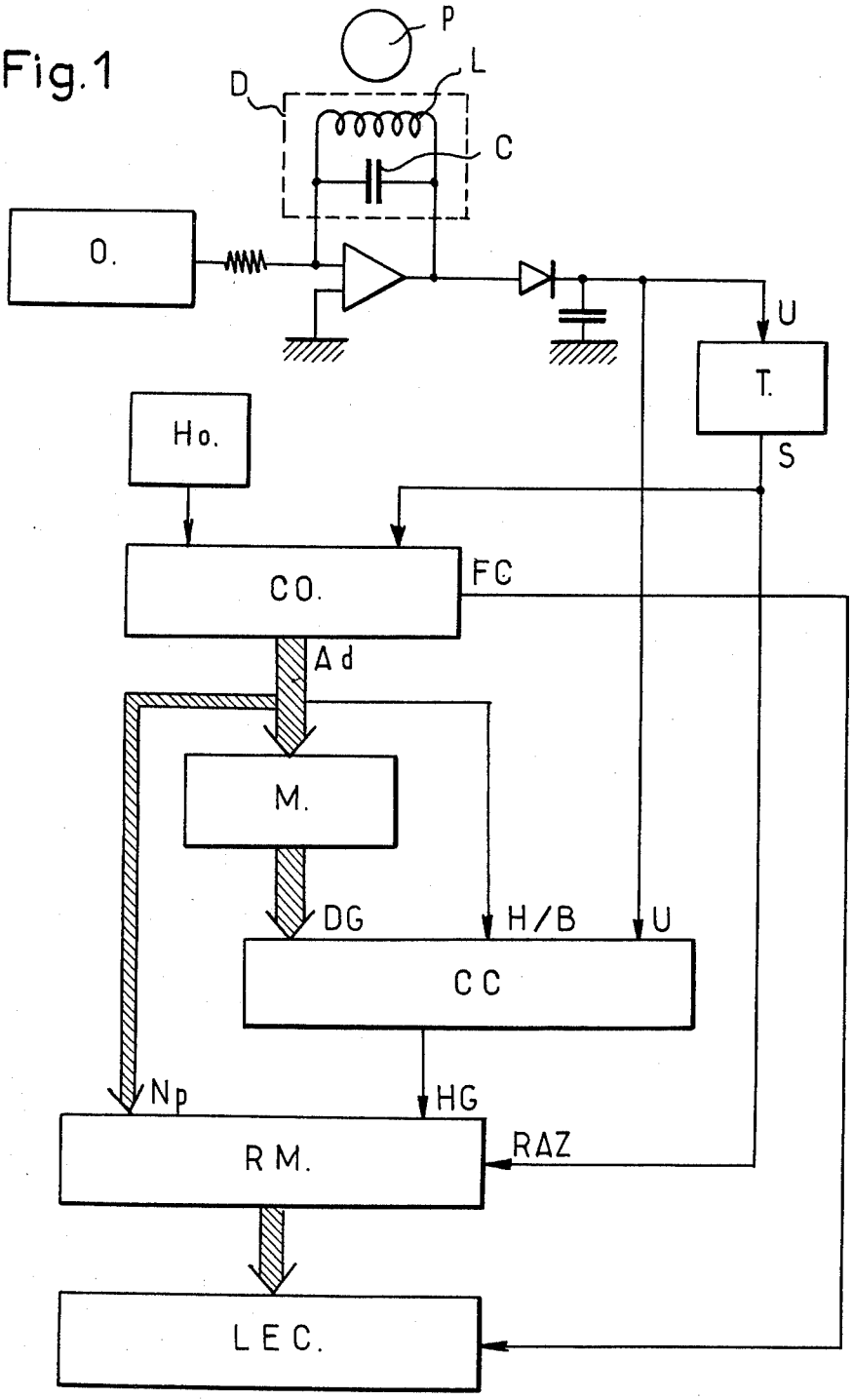
FIG. 1 is a block diagram of a coin checking device according to the invention.

With reference to FIG. 1, it can be seen that the checking device according to the invention comprises firstly an electromagnetic pick-up or detector p, in this case formed essentially by a coil L which is mounted in an open magnetic circuit having wide spatial distribution of the magnetic field in air at the point where the pieces or coins to be checked pass. The said coil is associated with a capacitor C and thus forms a tank circuit which, when detuned in relation to the frequency of the alternating current supply delivered to the said circuit, has its quiescent point in the ascending or descending part (according to choice) of the resonance curve.

The power supply of the tank circuit comprises in this case an a.c. generator of constant effective value, essentially formed by an oscillator O. Therefore, when a metal piece such as "p", for example a coin, passes in the vicinity of the detector D, the impedance variation of the tank circuit caused by the passing of the coin can be directly checked by measurement of the output voltage U, which has been previously filtered and rectified. In effect, this voltage assumes different values which depend, on the one hand, on the position of the coin relative to the detector and, on the other, on the diameter of the said coin, the nature of the metal of which the coin is made as well as its thickness.

With the coin or piece "p" passing in front of the detector D at a constant rate, the detected or collected voltage therefore constitutes a characteristic curve of each type of coin as a function of the time t.

Figure 2:
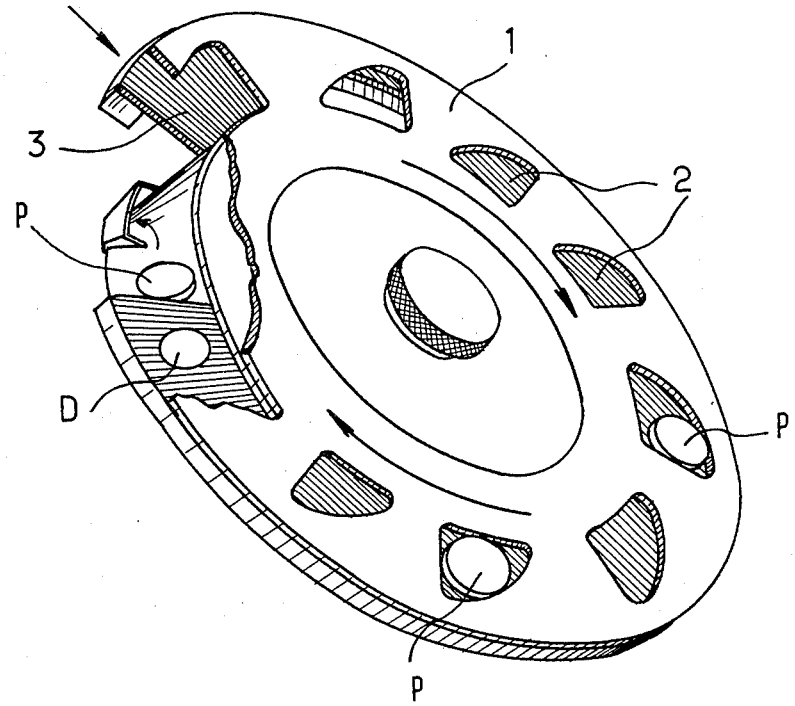
FIG. 2 is a perspective view of a device which permits the coins to be run at a constant speed past the detector of the checking device.

FIG. 2 is a perspective view of a device which allows the coins to run past the detector at a constant rate. This device, being of a known type, essentially comprises a disc 1 whose periphery is provided with sockets or recesses 2, each being suitable for receiving a coin "p" which is rotated at a constant rate in the direction indicated by the arrows, above a fixed plate 3 bearing the detector D.

However, it will be noted that such a device is only really effective when several coins or pieces are thrown loosely into a receiver, such as for example the automatic toll systems on motorways. Indeed, when for example automatic dispensers or public call boxes are involved, the coins are introduced one by one into the apparatus and therefore pass in front of the detector at a variable rate. In this case equivalent arrangements can be used to achieve the same result.

A first method consists of considering that the rate of movement of the coins (past the detector) is always the same for each type of coin. One is therefore brought back to the preceding problem by adapting the time scale.

A second method consists of locating the successive positions of the coin by means of detectors, such as photoelectric barriers suitably spaced at intervals along the path of the coin to be inspected.

Figure 3:
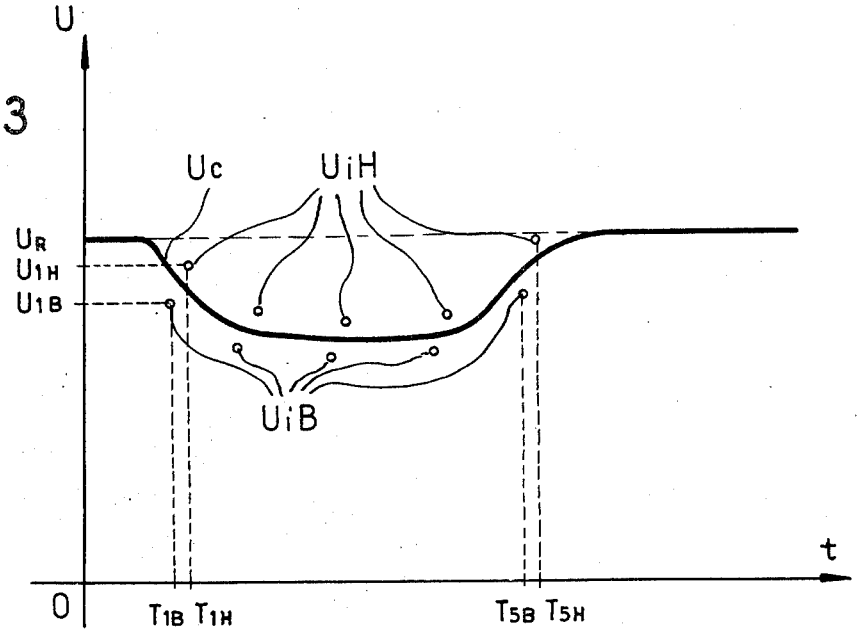
FIG. 3 represents the characteristic curve of a given coin.

Irrespective of which type of method is adopted, there is finally obtained for each type of coin a characteristic curve such as that shown in by way of example in FIG. 3. In this Figure the ordinates U are the voltages measured at the output of the detector; the abscissae T are the spaces or distances covered by the coin during detection; these distances are located either by time measurement (a case of being driven at a constant rate or a free fall at a known rate), or by the photoelectric barriers which the coin moves past successively.

In the following description it will be supposed, for the purpose of simplifying the description, that the piece is moved at a constant rate. In this case, the distances covered by the piece are proportional to the time from which is obtained the notation t as an abscissa from the graph of FIG. 3. In this Figure $U_R$ corresponds to the no-load voltage of the system and $U_C$ the voltage measured during the passing of a coin or piece.

In accordance with the invention, the curve thus obtained is compared by sampling with the different characteristic curves of the pieces to be measured, previously stored in the form of comparison values in a programmable non-volatile memory M. This memory will advantageously comprise an integrated circuit capable of being series mounted to permit interchangeability between various programs, corresponding to tokens or coins from different countries or even different types of metal pieces to be recognized.

Therefore, for each type of coin or piece, a sort of frame or former is formed from a given number $H_m$ of programmed values divided into high and low thresholds, the amplitudes of which encompass the characteristic curve of the said coin. Thus, in the example in FIG. 3, five high thresholds corresponding to five voltage values $U_{iH}$ have been adopted, as well as five low thresholds corresponding to five voltage values $U_{iB}$. These are the voltages $U_{iH}$ and $U_{iB}$ which will be programmed in the memory M.

Sequential analysis is the obvious procedure. Each measuring stage $N_m$ is divided into $N_p$ periods corresponding to the number of different coins to be checked and each period $N_p$ is in turn divided into two half-periods $T_{iB}$ and $T_{iH}$, corresponding respectively to the comparison with the low threshold B and with the high threshold H. FIG. 4 shows, by way of example, the different sequences which are necessary for checking four types of coins with five sampling measurements.

All these measuring sequences are obtained from an ordinal recorder or meter CO, which is controlled by the pulses of a clock HO and generates the cycle of addresses $A_d$ of the memory, that is to say, the measuring stage, period and half-period. The triggering action of the ordinal recorder is produced by a synchronization signal S obtained from a trigger T which is itself activated by the voltage U when the latter deviates from its quiescent value $U_R$.

The actual comparison is effected in a converter/-comparator unit CC which receives, apart from the voltage to be measured U, the frame data DG from the memory M and the interchange bit of the high threshold-low threshold H/B from the address $A_d$. This unit CC therefore provides the results of the comparisons effected to a memory register RM in $N_p$ positions, so-called off-line memory register, multiplexed by the bits $N_p$ of each type of coin coming from the address $A_d$.

At the beginning of the cycle, the memory register RM is at zero and all the coins or pieces are considered correct. During processing, at each step Ti of the program, the effected comparison determines whether the voltage Ui appears off-line for the coin or piece in question. In this case, an "off-line" piece of information HG is delivered by the unit CC and stored in the corresponding store location of the register RM, the said location therefore passing to one condition or state.

At the end of the measuring cycle, the ordinal counter delivers an end-of-cycle signal FC which activates the reading of the register RM by way of the circuit LEC. In order that the checked coin or piece may be considered correct, the corresponding store location or unit of the memory register should not have been activated by the information HG. In other words, at the end of the cycle, there must be only one unit or location of the memory at zero, which is exactly equivalent to the coin being recognized as correct.

After the said reading, the trigger T delivers a signal RAZ which returns the memory register RM to zero, thus allowing a new measuring cycle to commence.

The checking device according to the invention finally therefore permits metal pieces, and particularly coins, to be detected without mechanical contact, which increases reliability and permits an increased processing rate. Moreover, it has a great adaptability to multi-farious coinages or monetary systems since for this purpose it is sufficient to change the programs recorded in read-only stores.

What I claim is:

1. A device for checking metal pieces, particularly coins, characterized in that it comprises, in combination an electromagnetic detector responsive to the passing of metal pieces and formed by a tank circuit fed from an alternating current generator of constant effective output, means for passing pieces adjacent to the detector, means for measuring at predetermined periods of time the voltage value at the detector as influenced by variations in the impedance of the tank circuit as a result of the passing of the pieces, and means for comparing the thus measured voltge values with one or more sets of programmed voltage values previously stored in a memory, each said set defining a time-dependent voltage profile characteristic of a detected known metal piece to determine whether or not each passing piece corresponds to one of the known pieces.

2. A device for checking metal pieces as claimed in claim 1, characterized in that each measuring stage is divided into as many periods as there are types of pieces to be checked and each period is in turn divided into two half-periods corresponding respectively to the comparison with a low threshold and with a high threshold of the characteristic curve.

3. A checking device as claimed in claim 1, characterized in that the programmable memory comprises an integrated circuit capable of being series mounted.

4. A checking device as claimed in claim 2, characterized in that the programmable memory comprises an integrated circuit capable of being series mounted.

5. A device for checking metal pieces comprising a detector including an a.c. generator coupled to an impedance which is arranged such that the passage of metal pieces past the impedance causes a variation in an output voltage of the detector, means for measuring the varied output voltage at predetermined discrete stages in the passage of the piece, and means for comparing these varied output voltages with predetermined voltages characteristic of a particular piece to be checked.

6. A device for checking metal pieces comprising

A. a detector for responding to the passage of a metal piece by producing a voltage which varies depending upon the position of the metal piece relative to the detector, B. means for passing a metal piece past the detector so that the detector produces a time-dependent voltage whose waveform profile is characteristic of said metal piece, C. means for storing one or more sets of voltage values, the values in each set corresponding to the voltages produced by the detector when a known metal piece moving past the detector is positioned at selected locations relative to the detector, each different voltage value set thus defining a different time-dependent former or template characteristic of each different known metal piece, and D. means for virtually superimposing the time-dependent voltage waveform profile produced by the detector when an unknown metal piece is moved past the detector on each different time-dependent template for matching purposes so as to determine whether the unknown metal piece corresponds to one of the known metal pieces.

7. The device defined in claim 6 wherein the superimposing means includes

A. means for sampling the time-dependent voltage from the detector when the unknown metal piece is positioned at said selected locations relative to the detector, and B. means for comparing the voltage sampled at each said location with the stored voltage values for that location.

8. The device defined in claim 6 wherein each set of voltage values is comprised of a pair of subsets, the voltage values in each said subset pair defining, respectively, the upper and lower voltage value boundaries of each different template.

* * * * *

UNITED STATES PATENT AND TRADEMARK OFFICE

CERTIFICATE OF CORRECTION

PATENT NO. : 4,234,071

DATED : November 18, 1980

INVENTOR(S) : Son Le-Hong

It is certified that error appears in the above-identified patent and that said Letters Patent are hereby corrected as shown below:

Col. 1, line 66, change "p" to --D--.

Col. 2, line 53, delete "in".

Col. 2, line 55, change "T" to --t--.

Col. 2, line 65, change "t" to --t--.

Col. 3, line 12, change "$H_m$" to --$N_m$--.

Col. 4, line 23, change "voltge" to --voltage--.

Signed and Sealed this

*Second* Day of *June 1981*

[SEAL]

*Attest:*

RENE D. TEGTMEYER

*Attesting Officer*

*Acting Commissioner of Patents and Trademarks*